United States Patent [19]

Foley

[11] 4,008,940

[45] Feb. 22, 1977

[54] TELEPHONE APPARATUS INCLUDING ELECTRICAL CONNECTOR

[75] Inventor: James P. Foley, Astoria, N.Y.

[73] Assignee: Roanwell Corporation, New York, N.Y.

[22] Filed: June 9, 1975

[21] Appl. No.: 584,911

[52] U.S. Cl. ..... 339/91 R; 339/184 M

[51] Int. Cl.[2] ..... H01R 13/54

[58] Field of Search ..... 339/76, 77, 91 R, 91 P, 339/94 M, 184 M, 217 PS, 217 S, 253 R, 254 M, 255 R, 255 A, 75 M, 75 P

[56] References Cited

UNITED STATES PATENTS

| | | | |
|---|---|---|---|
| 3,721,939 | 3/1973 | Paugh | 339/91 R X |
| 3,829,821 | 8/1974 | Derr et al. | 339/91 R |

OTHER PUBLICATIONS

"A Transistor Amplifier For Operators' Headsets"; A. J. Chase; in Bell Laboratories Record, vol. 36 No. 10, pp. 381–383, (Oct. 1958).

*Primary Examiner*—Roy Lake
*Assistant Examiner*—E. F. Desmond
*Attorney, Agent, or Firm*—Cooper, Dunham, Clark, Griffin & Moran

[57] ABSTRACT

This telephone apparatus includes a headset module and a station module. The headset is of a lightweight type which requires an amplifier for the electrical signal produced by the microphone, in order for the output signal to be compatible with conventional telephone switchboard apparatus. The headset module also includes electrical conductors extending from the microphone and earphone of the headset to a latchable plug forming part of a connector. The station module includes a receptacle for receiving the latchable plug, an amplifier and a connector plug engageable with a conventional receptacle. That connector plug may be part of a rigid assembly including the other parts of the station module, or it may be connected to that assembly by flexible conductors.

6 Claims, 13 Drawing Figures

Fig. 4.
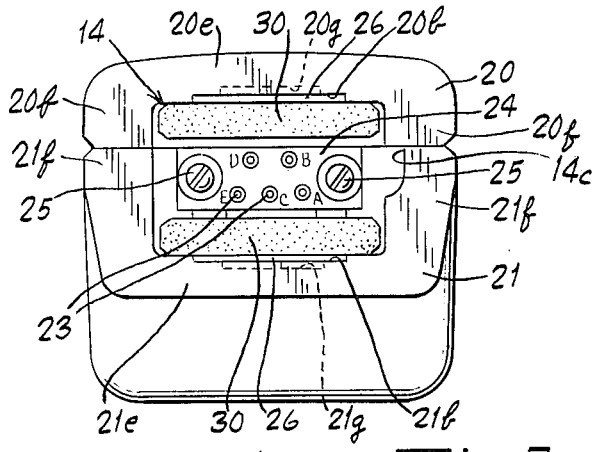
Fig. 5.
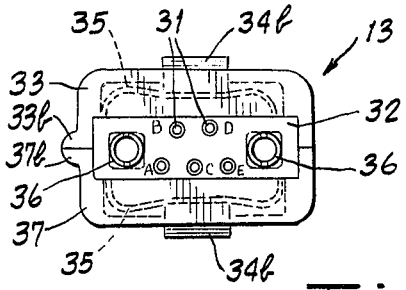
Fig. 6.
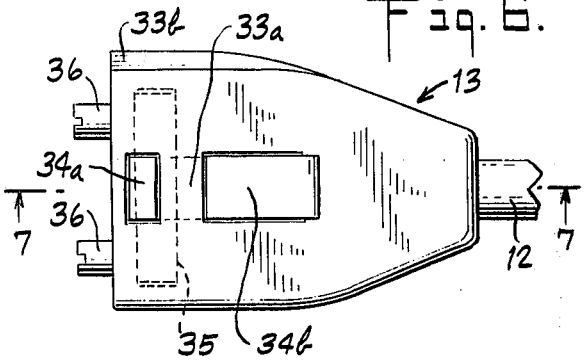
Fig. 7.
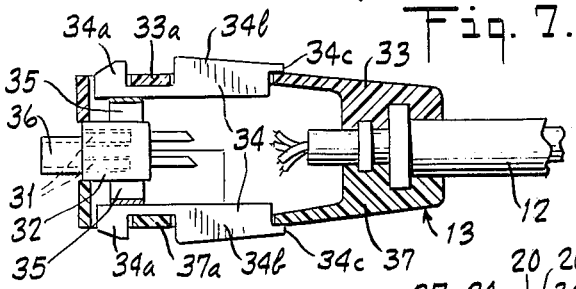
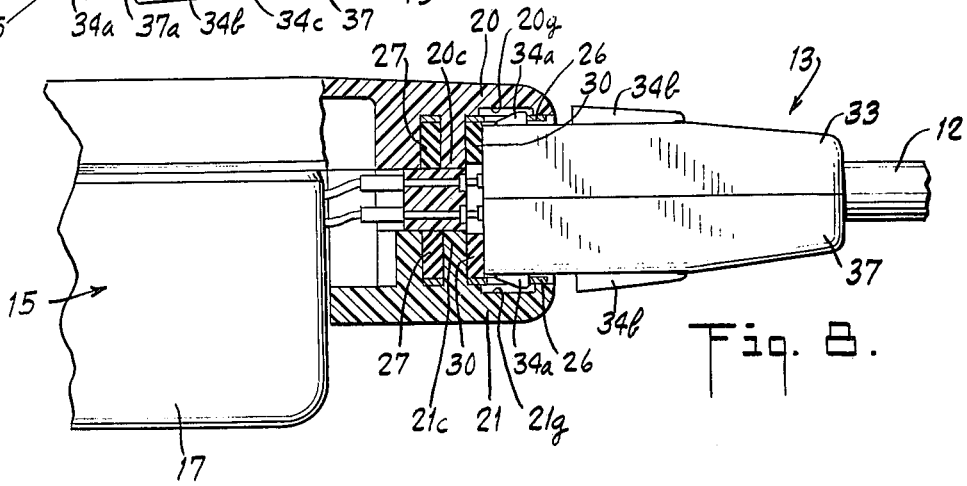
Fig. 8.
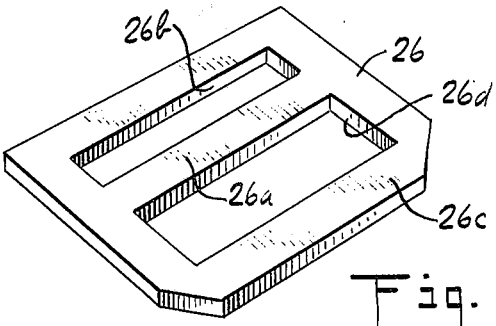
Fig. 9.

Fig. 10.
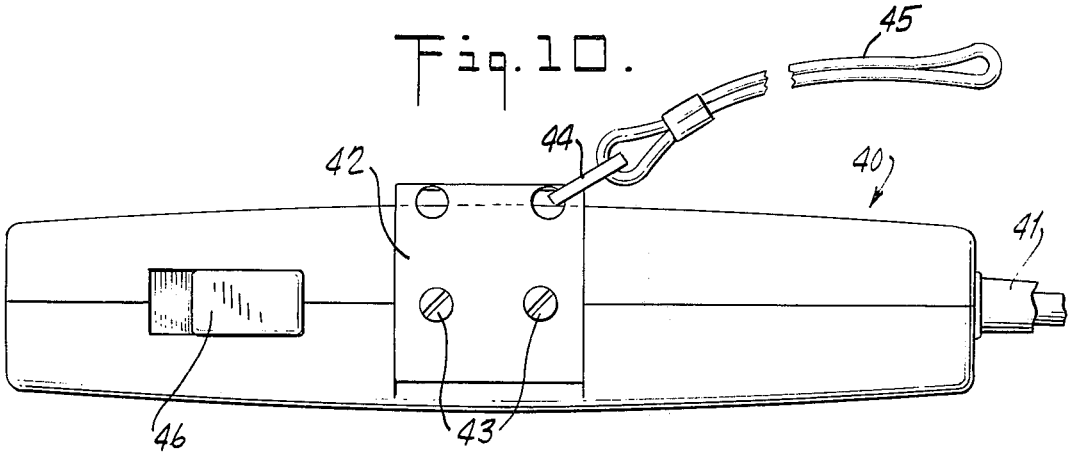
Fig. 11.
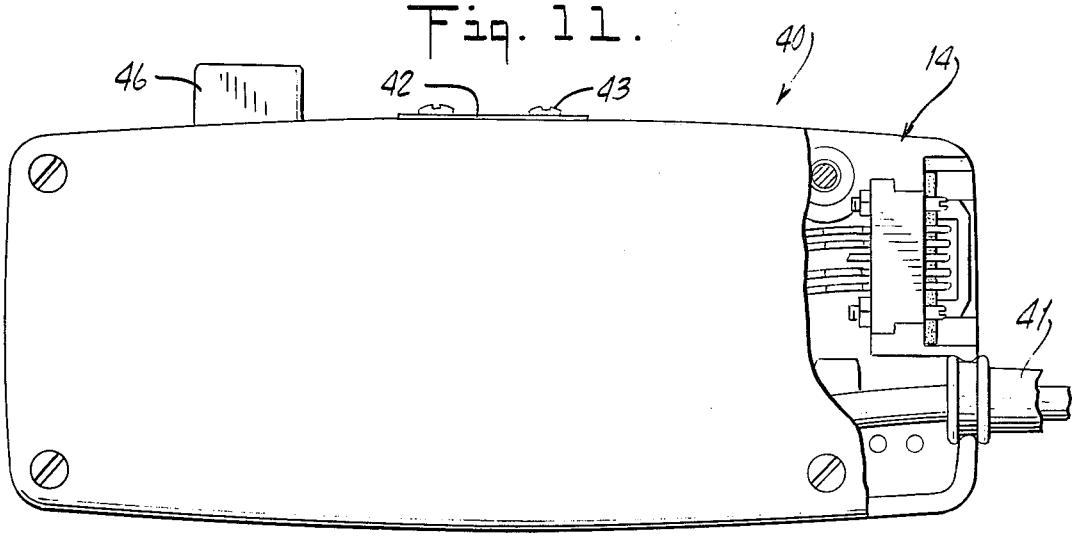
Fig. 12.
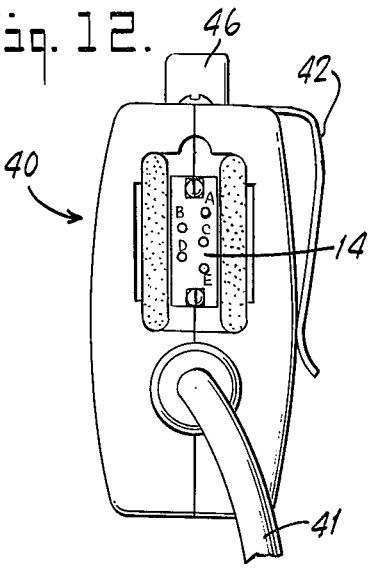
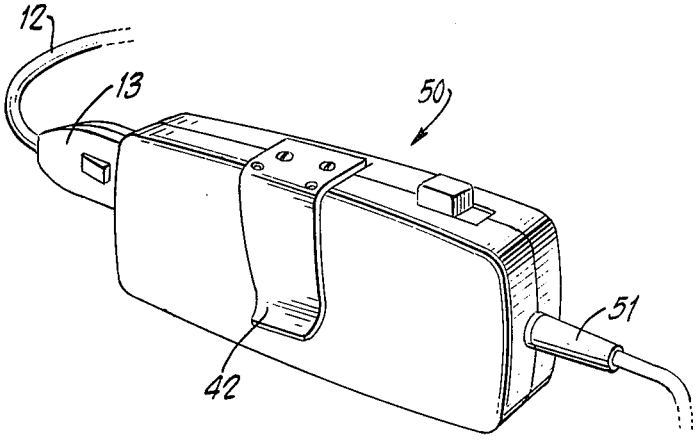
Fig. 13.

TELEPHONE APPARATUS INCLUDING ELECTRICAL CONNECTOR

CROSS-REFERENCE

The lightweight headset shown in this application may be of the type shown and described in greater detail in my copending application Ser. No. 555,529, filed Mar. 5, 1975, now U.S. Pat. No. 3,971,901, entitled "Communications Headset with Reversible Mounting Means."

BRIEF SUMMARY

Lightweight telephone operator headsets of the prior art have commonly required amplifiers in order for the output of the headset microphone to be compatible with conventional telephone switchboard apparatus. It has therefore been the practice to supply each headset with a permanently connected amplifier.

In the apparatus of the present invention the lightweight operator's headset is part of a headset module. The headset module includes a microphone, an earpiece, an earphone transducer, necessary supporting elements, and a cable connecting the microphone and the earphone transducer to a connector plug 13, which is also part of the headset module.

A station module includes an amplifier, a receptacle adapted to cooperate with the plug of the headset module, and a second connector plug adapted for insertion in a conventional switchboard. The amplifier and the receptacle are parts of the same rigid assembly. The second connector plug may be part of the same assembly through flexible conductors. The assembly may also include other elements, e.g., a control switch.

With this arrangement, a station module is provided for each switchboard station, rather than having an amplifier for each operator's headset. In any given installation, the number of switchboard stations is substantially smaller than the number of operators, so that a considerable economy of equipment is achieved.

The plug on the headset module and the receptacle on the station module together form an electrical connector which is lockable and manually releasable. Hence, the plug connector cannot become accidentally loosened or separated from the receptacle due to movements of the operator in the neighborhood of the switchboard station. Two latch members are provided on each plug and both must be manually released in order to separate the plug from the receptacle.

DRAWINGS

FIG. 4 is a right-hand view of the station module of FIGS. 2 and 3.

FIG. 5 is a left end elevational view of a connector plug forming part of the headset module of FIG. 1.

FIG. 6 is a plan view of the connector plug of FIG. 5.

FIG. 7 is a sectional view taken along the line 7—7 of FIG. 6.

FIG. 8 is a view partly in elevation and partly in section, showing the connector plug of FIGS. 5–7 assembled with the receptacle of FIGS. 2–4, with the receptacle shown in section.

FIG. 9 is a perspective view on an enlarged scale showing a latch plate used in the receptacle.

FIG. 10 is an elevational view showing a switch control case used in a modified form of station module embodying the invention.

FIG. 11 is a plan view of the switch control case of FIG. 10, with certain parts shown in section.

FIG. 12 is a right-hand elevational view of the switch control case of FIG. 11.

FIG. 13 is a perspective view showing another embodiment of a switch control case usable in a station module constructed in accordance with the invention.

DETAILED DESCRIPTION

HEADSET MODULE

FIG. 1

Figure 1:
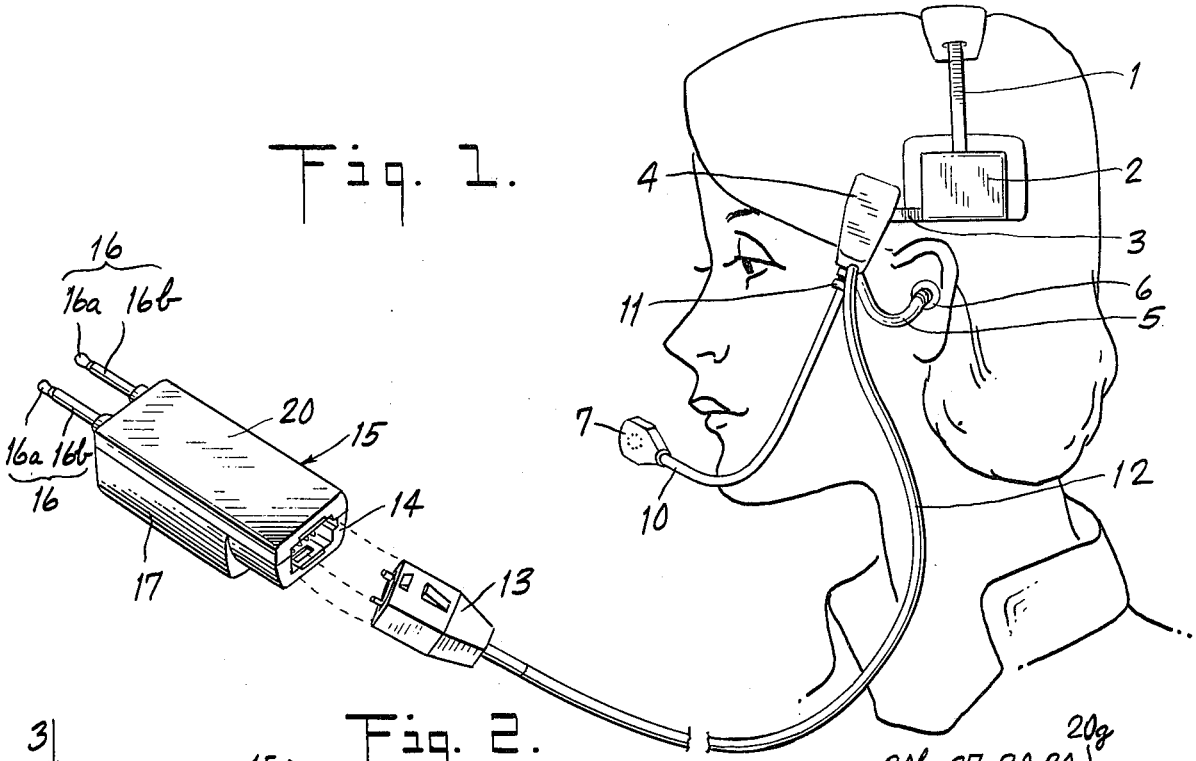
FIG. 1 is a perspective view showing an operator wearing a headset module including a connector plug and a station module including a receptacle for the connector plug and another connector plug adapted for plugging into a switchboard.

FIG. 1 shows an operator wearing a headset including a yoke 1 extending over the top of the head and terminating in a pair of pads 2, only one of which is seen in the drawing. A boom 3 extends forwardly from the pad 2 and supports at its forward end a housing 4 which encloses an earphone transducer. An acoustic path extends from the earphone transducer through a tube 5 to an earpiece 6 in the operator's ear. A microphone 7 is supported at the end of a curved conduit 10, whose opposite end is supported on the housing 4 by an electrical connector including an articulated plug assembly 11. Conductors connected to the earphone transducer and to the microphone 7 extend into the housing 4 and thence through a flexible cable 12 to a connector plug 13. The headset includes the yoke 1, pads 2, boom 3, housing 4, tube 5, earpiece 6, conduit 10, microphone 7 and plug assembly 11. The headset module includes the headset plus the cable 12 and connector plug 13.

STATION MODULE

FIGS. 1–4, 8 AND 9

Figure 2:
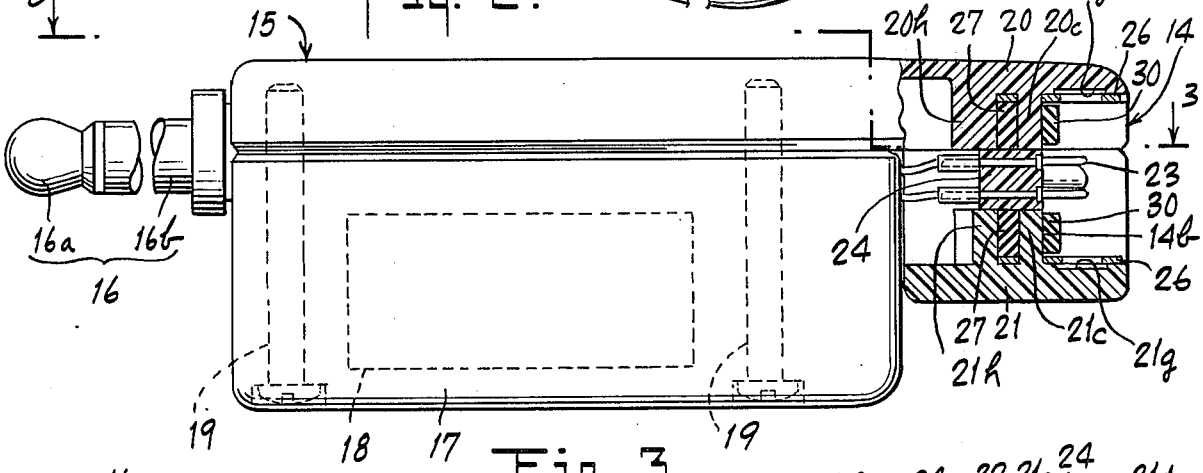
FIG. 2 is a view partly in elevation and partly in section, showing the station module appearing in FIG. 1, on a larger scale.
Figure 3:
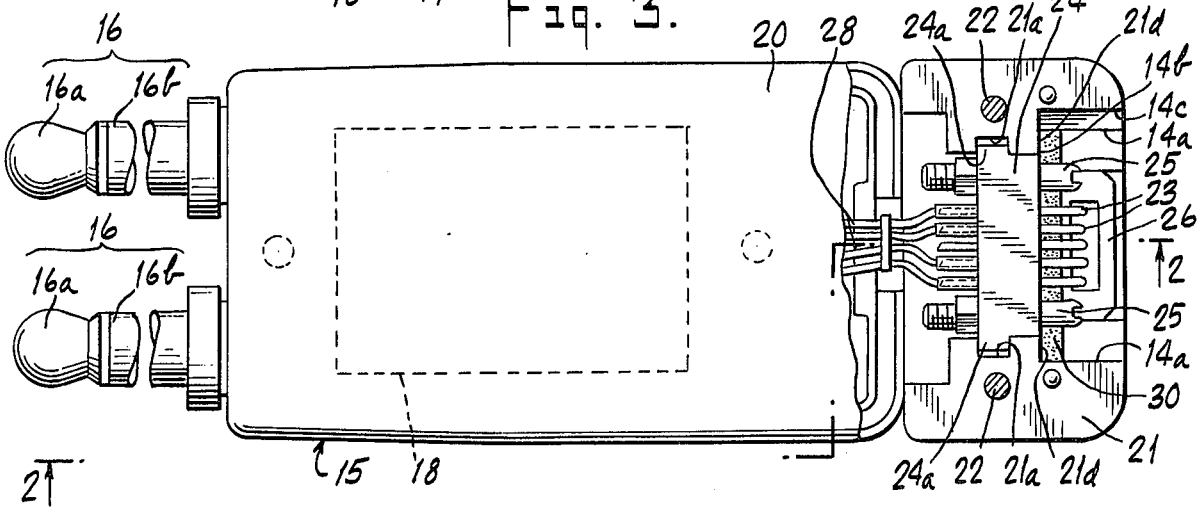
FIG. 3 is a view, partly in plan and partly in section on the line 3—3 of FIG. 2, showing the station module.

The connector plug 13 is insertable into a connector receptacle 14 formed on one end of a station module 15. The other end of the station module 15 carries a pair of projecting coaxial connector elements 16, adapted for insertion in a conventional switchboard. The station module 15 includes a housing 17 enclosing an amplifier shown diagrammatically at 18 (FIGS. 2 and 3).

The station module 15 includes an upper casing part 20 and a lower casing part 21 held together by screws 22 or other suitable retaining devices. The terms "upper" and "lower" are used simply for convenience with respect to the orientation of the station module as shown in FIG. 2. It should be understood that the station module may be used in any other orientation. The housing 17 is attached to the under side of the upper casing part 20 by means of screws 19, or other suitable retaining devices. The receptacle 14 includes part of the upper casing part 20 and all of the lower casing part 21. Receptacle 14 has a recess **14*a* formed in its end. The inner end 14*b* of the recess 14*a* serves as a seat for the plug 13. A plurality of electrically conductive connector elements, shown as pins 23, are fixed on the seat 14*b* by being molded in an insulating block 24 (FIG. 3) having flanges 24*a* (FIG. 3) received in grooves 21*a*** formed in the casing part 21. A pair of guide pins 25 are also molded in the block 24. The block 24 defines part of the inner end of recess 14*a*.

Each of the casing parts 20 and 21 has one complete side wall 20*e*, 21*e*, and two partial side walls, 20*f*, 21*f*. The side walls 20*e*, 21*e*, 20*f*, 21*f* together define the sides of the recess 14*a*. Each of the side walls 20*e*, 21*e* has a plane inner surface with a broad indentation 20*b*, 21*b* (FIG. 4) therein, and a notch 20*g*, 21*g* at the bottom of the indentation. A latch plate 26, best seen in FIG. 9, is received in each of the indentations 20*b*, 21*b* and comprises a generally rectangular frame with a bridging member 26*a* extending across the frame. Each of the casing parts 20 and 21 has a post 20*c*, 21*c* formed integrally therewith and projecting through the aperture 26*b* between the bridging member 26*a* and the innermost side of the latch plate 26. The parts 20 and 21 also include transverse walls 20*h*, 21*h* (FIG. 2) on which the block 24 is fixed. Spacer blocks 27 of sponge rubber or the like are bonded to and fill the spaces between the posts 20*c*, 21*c*, and the facing surfaces of the transverse walls 20*h*, 21*h*, so as to hold the latch plates 26 in place in the indentations 20*b*, 21*b*. The partial side walls 20*f*, 21*f* of the casing parts 20 and 21 are provided with shoulders, as shown at 21*d* in FIG. 3. The shoulders 21*d*, the post 21*c*, the corresponding shoulders and post of the upper casing part 20, and the insulating block 24, together define the inner end of the recess 14*a*. Cushion strips 30 (FIGS. 2–4) of sponge rubber or the like are bonded at their ends to the shoulders such as 21*d* as well as to the posts 20*c*, 21*c*.

Wires 28 (FIG. 3) extend from the inner ends of the connector pins 23 through openings in the facing ends of the casing part 21 and the housing 17. The wires may also be accommodated in the open under side of the casing part 20. Two of the wires lead to the input terminals (not shown) of the amplifier 18. The output terminals of the amplifier are connected to the center tips 16*a* of the coaxial connectors 16. The other two wires 28 are connected, possibly through circuit elements in the housing 17, to the sleeves 16*b* of the connectors 16.

CONNECTOR PLUG

FIGS. 5–8

The connector plug 13, shown in detail in these figures, includes a set of electrically conductive connector elements 31, shown as hollow receptacles for receiving the pins 23 in the receptacle 14. The connector elements 31 and a pair of guide sleeves 36 are molded into a block 32 which is fixed between the upper and lower casing halves 33, 37 of the plug 13. Two latch members 34 are movably supported on the plug 13. Each latch member 34 has a latch tooth 34*a* and an operating segment 34*b*. Each casing half is provided with apertures through which the tooth 34*a* and the operating segment 34*b* project Between those apertures, bridging portions 33*a*, 37*a* of the casing halves 33, 37 extend across the latch members 34. Each latch member has a finger 34*c* on its outer side at its right-hand end, as viewed in FIG. 7, which engages the outside of the casing half 33, 37 and prevents the latch member 34 from moving into the cavity defined by the hollow casing halves 33, 37.

The latch members 34 are biased to their outer or latching positions, seen in FIGS. 5–7, by means of broad U-shaped leaf springs 35. The ends of each leaf spring 35 are bent over and engage a surface of the block 32. The middle of each leaf spring 35 engages the inside of one of the latch members 34.

As the connector plug 13 is moved to engage the receptacle 14, the latch teeth 34*a* are forced inwardly into the cavity in the connector plug 13 when they engage the transverse frame member 26*c* (FIG. 9) of the latch plate 26. The leading end of each latch tooth 34*a* is beveled so that it slides past the transverse frame member. After the latch teeth 34*a* slide past transverse frame member 26*c*, they are moved outwardly by their associated springs 35 so that the square shoulder at their right-hand ends, as viewed in FIGS. 7 and 8, moves into the opening 26*d* in the latch plate 26, thereby locking the connector plug 13 firmly to the receptacle 14. The cushion strips 30 are compressed when the plug 13 is in its latching position, and bias the plug outwardly so that the latch teeth 34*a* are held in firm engagement with the latch plate 26. The connector plug 13 cannot then be removed from the receptacle 14 by pulling on the cord 12 at its right-hand end. In order to separate the plug 13 from the receptacle 14, the two operating segments 34*b* of the latch members 34 must be depressed, i.e., forced inwardly toward the cavity in the connector plug 13, thereby moving the latch teeth inwardly and releasing the latch teeth from the latch plate 26, so that the plug 13 may be withdrawn.

The casing halves 33, 37 are provided with abutting ridges 33*b*, 37*b* (FIG. 5), which together form a projection receivable in a groove 14*c* formed in one side of the receptacle 14. This projection is a polarizing key which prevents improper orientation of the plug 13 when it is inserted into the receptacle 14.

FIGS. 10–12

These figures illustrate a modification of the station module according to the invention, including a switch control case 40, in which the receptacle 14 is located at the right-hand end of the case. A connecting cable 41, which leads to a connector (not shown) having connecting elements similar to the connecting elements 16 of FIG. 1, is located at the same end of the case 40 as the receptacle 14. A spring clip 42 is attached to the housing of the case 40 by means of screws 43. A link 44 engages a hole in the spring clip 42. A loop 45 engages the link 44, and is adapted for hanging either on the wrist of the operator, or on a suitable hook on the switchboard. The link 44 and loop 45 are omitted from FIGS. 11 and 12. A push-to-talk switch 46 is provided on the case 40.

The clip 42 may be used to hang the case from a belt or pocket of the operator's clothing, or it may be used to hang the case on a suitable support on the switchboard station.

FIG. 13

This figure illustrates another switch control case 50, which differs from the case 40 of FIG. 12, in that the connector plug 13 and its associated receptacle 14 (not shown in FIG. 13) are at one end of the case, and a cable connection 51 to the switchboard is at the opposite end of the module.

I claim:

1. An electrical connector including:

a. a receptacle having a recess in a surface thereof;

b. a seat in the recess;

c. a first electrically conductive connector element fixed on the seat;

d. two latch plates in the recess at opposite sides thereof;

e. a plug insertable in the recess so that an end of the plug engages the seat;

f. a second electrically conductive connector element on the plug and adapted to mate with the first element when the plug is engaging the seat;

g. two latch members movably supported within the plug at opposite sides thereof, each member having a tooth and an operating segment, said segments projecting outside opposite lateral surfaces of the plug;

h. spring means biasing each latch member to a latching position in which the tooth extends outside one of said lateral surfaces of the plug, each member being movable against its bias to a latch releasing position in which the tooth is retracted within the plug;

i. said latch plates being adapted to be engaged by the teeth on the latch members when said plug engages the seat and said members are in their latching positions, said teeth being releasable from said latch plates by gripping said plug manually at said opposite lateral surfaces to move said segments and thereby said latch members against said spring means; and j. means yieldably engaging the end of a plug inserted in the recess and biasing it in a direction to hold the latch teeth firmly against the latch plate.

2. An electrical connector as in claim 1, in which the receptacle comprises:

a. two casing parts of insulating material, each of said parts including one complete side wall and two partial side walls, the two complete side walls defining one pair of opposed sides of the recess, the two partial side walls of one part cooperating with the two partial side walls of the other part to define another pair of opposed sides of the recess;

b. each complete side wall having a plane inner surface with a broad indentation therein;

c. each latch plate being received in one of said indentations, said latch plate having a thickness equal to the depth of the indentations;

d. each latch plate having a first aperture therein for receiving a latch tooth, and each complete side wall having a notch in its inner surface aligned with said aperture for receiving the latch tooth;

e. each complete side wall having a post projecting inwardly therefrom and through a second aperture in the latch plate;

f. a block bonded to each post and holding the latch plate within the indentation;

g. each said partial side wall having a shoulder projecting inwardly therefrom in alignment with the post;

h. said yieldably engaging means comprising a sponge rubber strip on each casing part, bonded at its ends to the shoulders on opposed partial side walls, said strips defining said seat; and i. means fastening the two casing parts together;

j. said sponge rubber strips holding the latch teeth against one side of said first aperture in the latch plate.

3. An electrical connector as in claim 2, including an insulating block of moldable material in which said first connector element is molded, said block having flanges received in grooves in at least one of the casing parts, and defining part of the bottom of the recess.

4. An electrical connector as in claim 1, in which the plug comprises:

a. two hollow housing parts of insulating material fastened together to define a cavity between them;

b. each said housing part having two apertures in a lateral face thereof, said apertures being separated by a bridge integral with the housing part;

c. each said latch member having its tooth projecting through one aperture, its operating segment projecting through the other, and a finger projecting from the operating segment outside of and parallel to the housing part, at the end of the latch member remote from the tooth, said finger limiting the inward motion of the operating segment toward the latch releasing position.

5. An electrical connector as in claim 1, in which said spring means comprises, for each latch member, a U-shaped leaf spring having its ends fixed, and the middle of the spring engaging the latch member.

6. An electrical connector as in claim 5, including an insulating block of moldable material in which said second connector element is molded, said block serving as a fixed abutment for the ends of both leaf springs.

* * * * *